US006511308B2

(12) United States Patent
Shaffer

(10) Patent No.: US 6,511,308 B2
(45) Date of Patent: Jan. 28, 2003

(54) SCROLL VACUUM PUMP WITH IMPROVED PERFORMANCE

(75) Inventor: Robert W. Shaffer, Hamilton, OH (US)

(73) Assignee: Air Squared, Inc., Hamilton, OH (US)

( * ) Notice: Subject to any disclaimer, the term of this patent is extended or adjusted under 35 U.S.C. 154(b) by 0 days.

(21) Appl. No.: 09/751,057

(22) Filed: Jan. 2, 2001

(65) Prior Publication Data

US 2001/0001639 A1 May 24, 2001

Related U.S. Application Data

(63) Continuation-in-part of application No. 09/715,726, filed on Nov. 20, 2000.

(51) Int. Cl.[7] ..... F01C 1/02

(52) U.S. Cl. ..... 418/55.6; 418/99; 418/55.2; 418/55.1; 29/888.022

(58) Field of Search ..... 418/55.6, 99, 1, 418/55.2, 55.1; 29/888.022

(56) References Cited

U.S. PATENT DOCUMENTS

| | | | | |
|---|---|---|---|---|
| 3,802,809 A | | 4/1974 | Vulliez | 418/55.2 |
| 4,382,754 A | | 5/1983 | Shaffer et al. | 418/55.2 |
| 4,457,674 A | | 7/1984 | Kawano et al. | 418/5 |
| 4,462,771 A | | 7/1984 | Teegarden | 29/888.022 |
| 4,472,120 A | | 9/1984 | McCullough | 418/55.1 |
| 4,477,238 A | | 10/1984 | Terauchi | 418/5 |
| 4,722,676 A | * | 2/1988 | Sugimoto | 418/55 |
| 4,726,100 A | | 2/1988 | Etemad et al. | |
| 4,730,375 A | | 3/1988 | Nakamura et al. | 418/55.4 |
| 4,732,550 A | | 3/1988 | Suzuki et al. | 418/55.4 |
| 4,875,839 A | | 10/1989 | Sakata et al. | |
| 5,040,956 A | * | 8/1991 | Barito et al. | 418/55.4 |
| 5,082,430 A | | 1/1992 | Guttinger | 418/55.2 |
| 5,258,046 A | | 11/1993 | Haga et al. | 418/55.2 |
| 5,616,015 A | * | 4/1997 | Liepert | 418/55.2 |
| 5,632,612 A | | 5/1997 | Shaffer | 418/55.4 |
| 5,759,020 A | | 6/1998 | Shaffer | 418/55.2 |
| 5,855,473 A | * | 1/1999 | Liepert | 418/55.2 |
| 5,961,297 A | * | 10/1999 | Haga et al. | 418/55.1 |
| 6,068,459 A | * | 5/2000 | Clarke et al. | 418/55.4 |
| 6,074,185 A | * | 6/2000 | Protos | 418/55.4 |
| 6,186,755 B1 | * | 2/2001 | Haga | 418/55.2 |

FOREIGN PATENT DOCUMENTS

| | | | |
|---|---|---|---|
| GB | 2002455 | 8/1978 | 418/55.2 |
| GB | 0513827 | 5/1992 | 418/55.1 |
| JP | 109981 | 4/1995 | |

* cited by examiner

*Primary Examiner*—Thomas Denion
*Assistant Examiner*—Thai-Ba Trieu
(74) *Attorney, Agent, or Firm*—Paul M. Denk

(57) ABSTRACT

A scroll compressor having improved efficiencies includes a fixed plate having a spiral involute and an orbiting plate having a spiral involute wrap. The fixed and orbiting plates are positioned in a housing such that the spiral involute wraps mesh with each other to define chambers. A sealant being applied to tips and sides of said involute wraps, said sealant substantially is closing any gaps between the tip of the involute wrap and the plate opposing the involute wrap. The sealant is chosen from the group consisting essentially of a grease, a dampening gel, and an epoxy. If a grease is used, then the grease is preferably a low vapor pressure grease. During assembly of the scroll compressor, the sealant is applied to tips and sides of the involute wraps. After the scroll compressor has been assembled, it is run to purge excess sealant, leaving sealant only in the gaps between the two scrolls. If an epoxy is used as a sealant, and the epoxy requires curing, the scroll compressor is disassembled after the initial run and the epoxy is cured. The scroll compressor is then reassembled.

1 Claim, 4 Drawing Sheets

SCROLL VACUUM PUMP WITH IMPROVED PERFORMANCE

CROSS-REFERENCE TO RELATED APPLICATIONS

This application is a continuation-in-part of application Ser. No. 09/715,726, filed Nov. 20, 2000 entitled TWO STAGE SCROLL VACUUM PUMP WITH IMPROVED PRESSURE RATIO AND PERFORMANCE, and which is incorporated herein by reference.

STATEMENT REGARDING FEDERALLY SPONSORED RESEARCH OR DEVELOPMENT

Not Applicable.

BACKGROUND OF THE INVENTION

This invention relates to scroll compressors, expanders, and vacuum pumps where grease, dampening gel or epoxy is used for improving the performance of the device.

Scroll devices have been used as compressors and vacuum pumps for many years. In general, they have been limited to a single stage due to the complexity of two or more stages. Oil free or oilless scroll type compressor and vacuum pumps are difficult and expensive to make, due to the high precision needed for the scrolls. For oil lubricated scroll compressors and vacuum pumps, swing links are often used to minimize the leakage gaps in the scrolls by allowing the scrolls to contact on the scroll surfaces. Swing links cannot be used in an oil free or oilless scroll compressor due the to friction and wear that will occur in the absence of lubrication. If the scrolls are not precisely made in an oil free scroll compressor, then leakage can occur, and performance will drop.

In U.S. Pat. No. 4,802,837 to Kazutaka, a scroll compressor is disclosed in which the scroll is coated with a plastic material by injection molding. Although this method reduces the cost of machining the scrolls, it still requires injection molding, and, if the unit is oilless, machining will be needed on the plastic to achieve good performance. The injection molding of scrolls is thus expensive.

In U.S. Pat. No. 5,803,723, also to Kazutaka, another scroll compressor is shown in which a coating is applied to the scroll. The coating is then worn off using a swing link with a fixed stop. As noted above, the use of a swing link is expensive. The patent does not teach how the coating is applied, however, the coating is thicker than needed so that some of the coating can be worn off.

BRIEF SUMMARY OF THE INVENTION

Briefly stated, a scroll compressor having improved efficiencies includes a fixed plate having a spiral involute and an orbiting plate having a spiral involute wrap. The fixed and orbiting plates are positioned in a housing such that the spiral involute wraps mesh with each other to define chambers. A tip seal and sealant is applied to tips and sides of the involute wraps, the tip seal and sealant substantially close any leakage gaps between the tip of the involute wrap and the plate opposing the involute wrap and the sides of the involute wraps. The sealant is chosen from the group consisting essentially of a grease, a dampening gel, and a one or two part epoxy. If a grease is used, then the grease is preferably a low vapor pressure grease.

During assembly of the scroll compressor, the sealant is applied to the tips and sides of the involute wraps. After the scroll compressor has been assembled, it is run to purge excess sealant, leaving sealant only in the gaps between the two scrolls. If an epoxy is used as a sealant, and the epoxy requires curing, the scroll compressor is disassembled after the initial run and the epoxy is cured. The scroll compressor is then reassembled.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
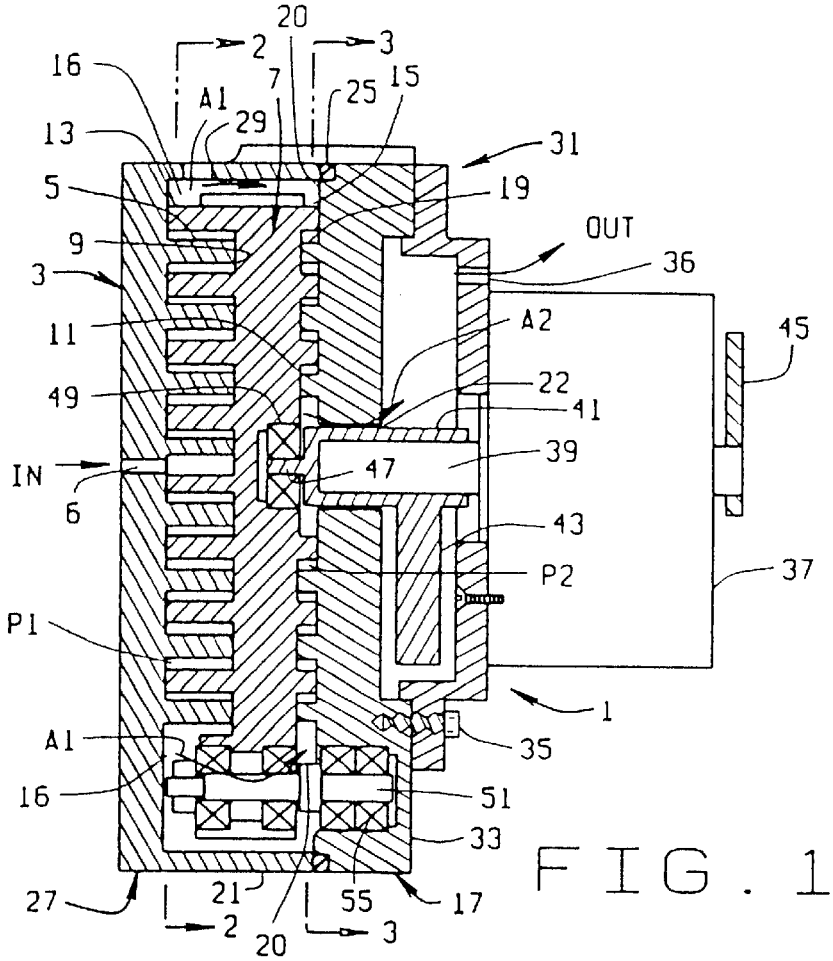
FIG. 1 is a sectional view of a two-stage scroll vacuum pump of the present invention.

A two stage scroll vacuum pump 1 of the present invention is shown generally in FIG. 1. The scroll vacuum pump 1 includes a first stage fixed scroll or plate 3 having an involute wrap 5. An inlet port 6 is located in the center of the fixed plate 3. An orbiting plate 7 has a lower surface 9 and an upper surface 11 with lower (or first stage) and upper (or second stage) involute wraps 13 and 15. The orbiting involute wrap 13 for the first stage extends down from the lower surface 9 and the orbiting involute wrap 15 extends up from the upper surface 11.

Figure 2:
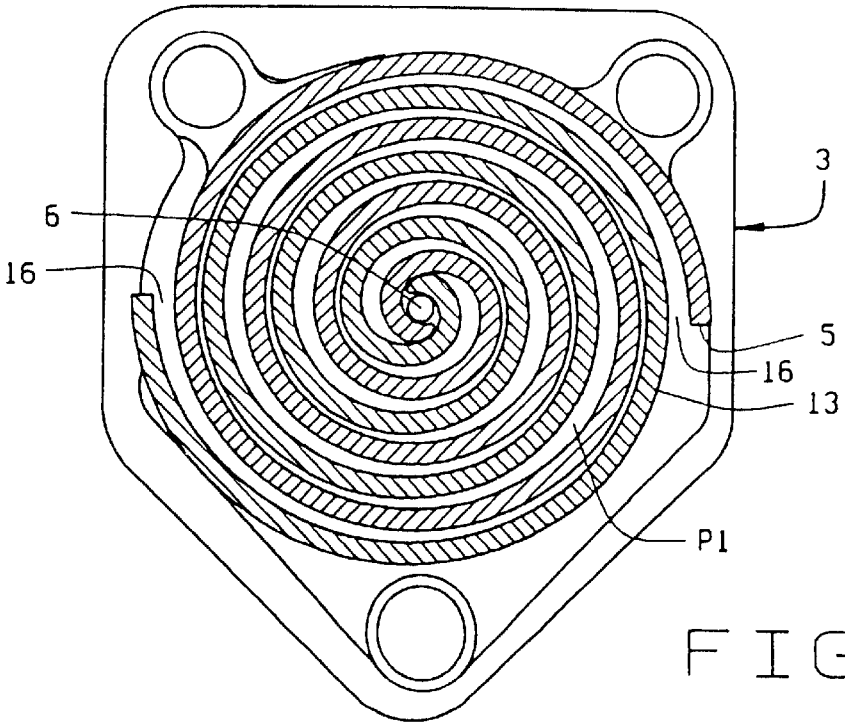
FIG. 2 is a cross-sectional view of the first stage of the scroll vacuum pump taken along line 2—2 of FIG. 1.

The first stage involute wraps 5 and 13 mesh as shown in FIG. 2 to define first stage pockets P1. As the orbiting wrap 13 moves relative to the fixed wrap 5, the pocket P1 expands in size from the inlet 6 to the first stage outlet 16 at the periphery of the first stage.

Figure 3:
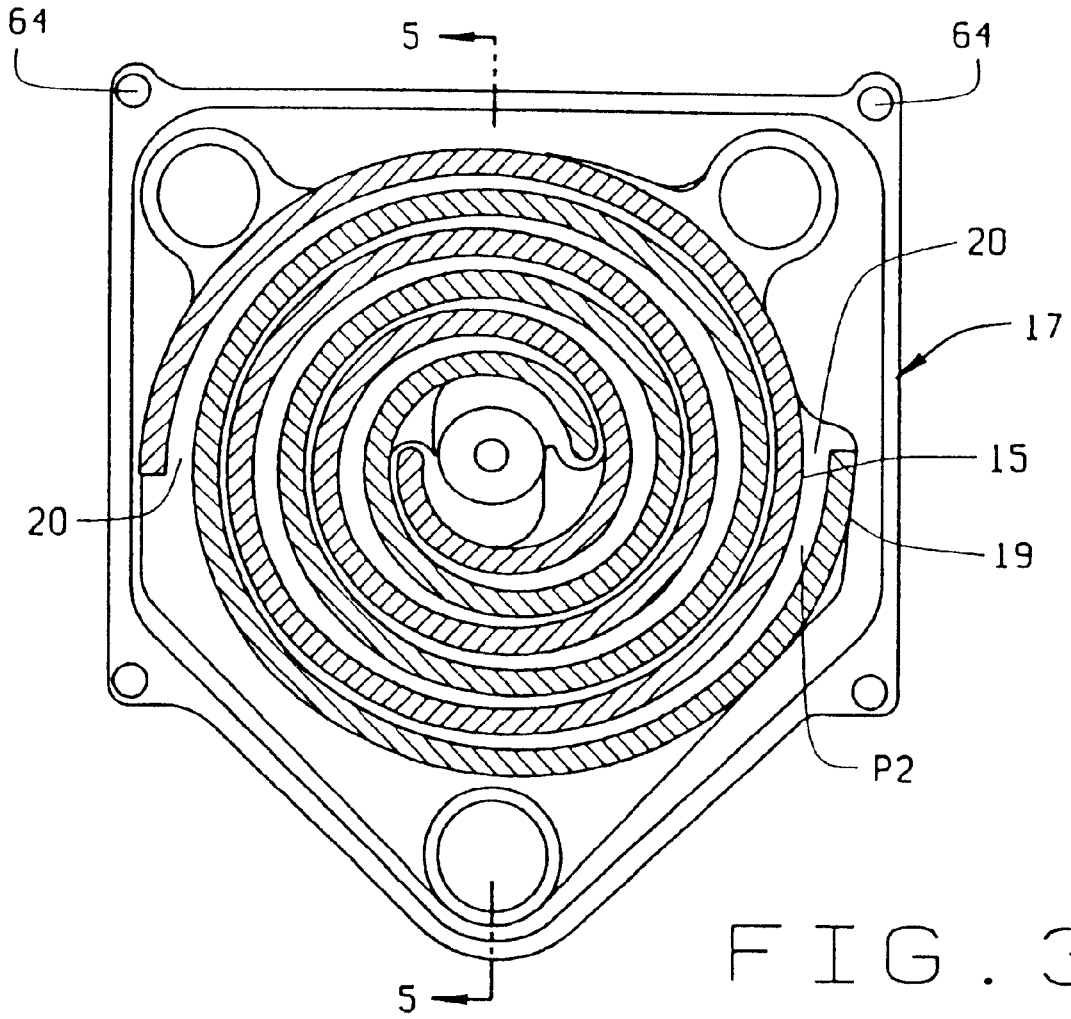
FIG. 3 is a cross-sectional view of the second stage of the scroll vacuum pump taken along line 3—3 of FIG. 1.

A second stage fixed scroll or plate 17 is positioned above the orbiting plate 7, and includes a second stage fixed involute wrap 19 which meshes with the orbiting involute 15, as seen in FIG. 3. The second stage wraps 17 and 19 define pockets P2 which decrease in size from the entrance 20 at the periphery to the second stage to the exit 22 at the center of the second stage. As best seen in FIG. 1, the first stage wraps 5 and 13 are larger (i.e., taller) than the second stage wraps 15 and 19.

The fixed scroll plate 3 includes a side wall 21 which extends up from the base of the fixed scroll plate. The second stage fixed plate 17 rests on the first stage fixed plate wall 21 and is aligned with the wall 21 in a conventional manner, for example, with dowel pins (not shown). Fastening means, such as screws, bolts, etc. are provided, as at 64, to secure the scrolls in place. An O-ring 25 is seated in a groove in the second stage fixed plate 17 to form a gas tight seal between the first and second stages. As seen in FIG. 1, the first and second stage fixed plate form a lower housing 27 for the vacuum pump 1. An interstage pressure or vacuum outlet 29 can be formed in the wall 21 at the outlet 16 from the first stage.

An upper housing 31 is fixed to the outer surface 33 of the second stage fixed plate 17 using a suitable fastener 35, such as a screw, bolt, or the like. An outlet port 36 is formed in the top of the housing 31 and defines an outlet for the vacuum pump 1. A motor 37 is mounted to the housing 31 to drive the orbiting plate 7. The motor 37 has an output shaft 39. A crankshaft 41 having an eccentric weight 43 is journaled about the output shaft. A counterweight 45 is mounted to the top of the motor 35 at the opposite end of the output shaft 39. The crankshaft extends through the second stage fixed scroll. A bottom pin 47 extends from the bottom of the crank shaft. The pin 47 is eccentric to the orbiting plate 7 and has a bearing 49 journaled thereabout. The bearing 49, in turn, is received in a recess in the orbiting plate 7 in the center of the orbiting plate. The orbiting scroll is supported by idler shafts 51 and supporting bearings 55 as disclosed in U.S. Pat. No. 5,466,134, which is incorporated herein by reference.

As can be seen by the arrows A1 and A2, the air is pulled in at the center of the first stage at the inlet 6, and is moved to the first stage outlet 16 at periphery of the first stage, causing the air to expand. The expanded air follows the arrow A1 to move from the periphery of the first stage to the entrance 20 to the second stage at the periphery of the second stage. In the second stage, the air is moved to the center of the fixed scroll to compress the air. The air exits the second stage at the second stage exit 22 and, following the arrow A2, enters the upper housing 31 along the crank shaft 41. The air then exists the upper housing 31 at the vacuum pump outlet 36, which is at atmospheric pressure. Because the drive shaft is at atmospheric pressure, no special sealing of the drive shaft is required.

The first stage expansion ratio can be any amount greater than or equal to one. The displacement of the first stage, however, is greater than the second stage so that the inter-stage pressure will be at some value between the first stage inlet and the second stage discharge. The second stage compression ratio is greater than or equal to one.

Figure 4:
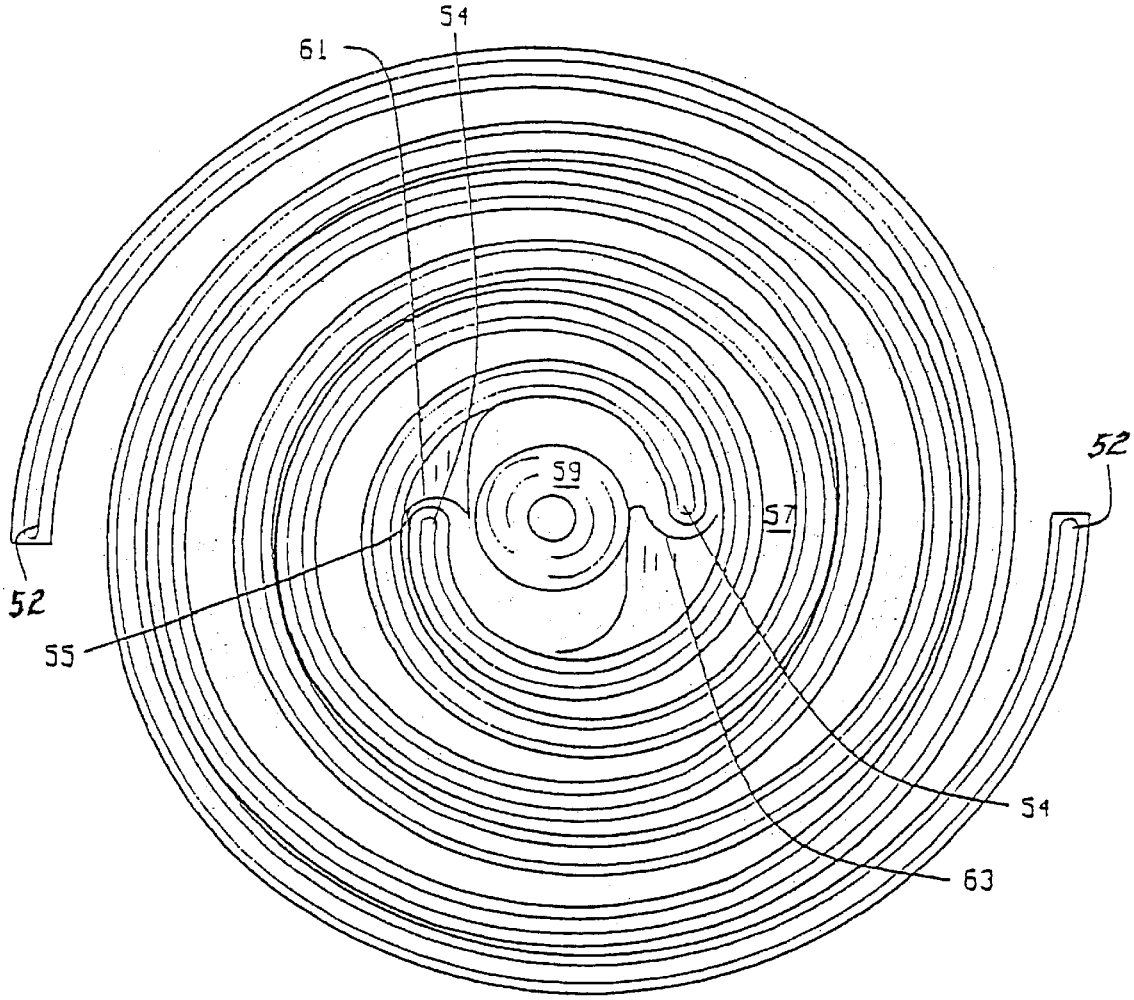
FIG. 4 is a plan view of the second stage showing an improved porting means at the center of the scroll.

FIG. 4 shows an improved porting means at the center of the second stage fixed scroll. The scroll includes involute spirals 52 having tip seals 54. The tip seal 54 is extended as close as possible to the center of the involute 52. Normally, as one scroll orbits clockwise about the other, the scrolls will port in the position shown, with the contact formed at 55. As the scroll moves clockwise, the gap at 55 will open, causing exposure of the gas trapped in the gaps 57 between the spirals 52 to the gas in the discharge area 59. However, by properly sizing the radius at the end of the scroll involute 61, and the porting radius 63, the porting can be delayed by 180° of rotation. This greatly increases the compression (or expansion) ratio, thus improving performance.

Figure 5:
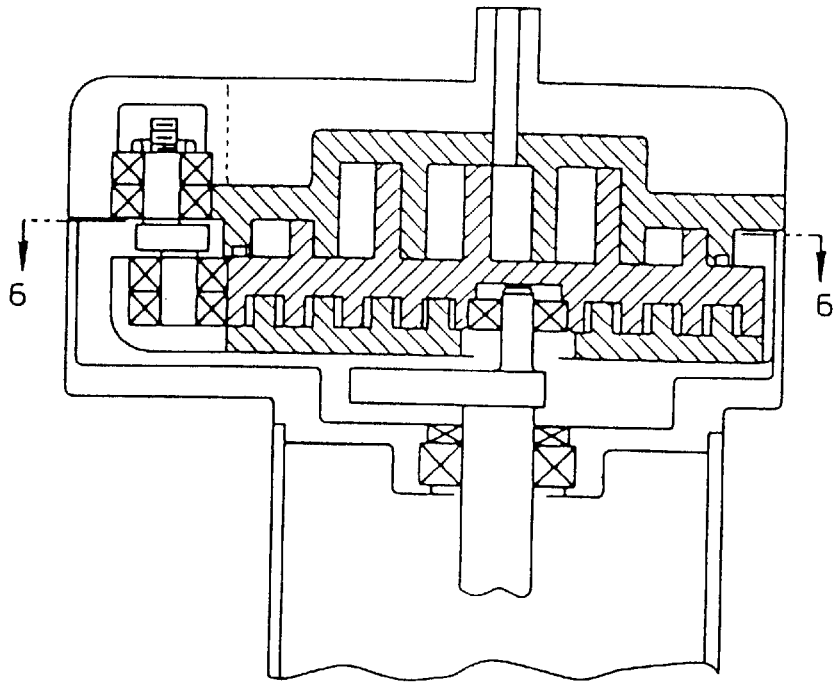
FIG. 5 is a cross-sectional view of an alternative embodiment of the two-stage scroll vacuum pump.
Figure 6:
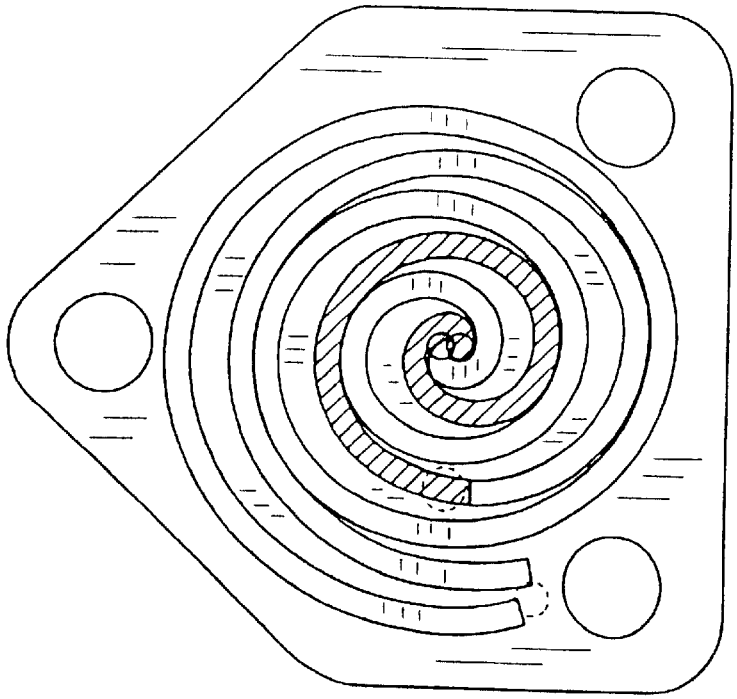
FIG. 6 is a cross-sectional view taken along line 6—6 of FIG. 5.

An alternative configuration of the first stage is shown in FIGS. 5 and 6. In this configuration, two fixed plates and a single orbiting plate is provided. The size of the involutes of the plates change, as can be seen in the figures. By stepping the involute height, as shown in the figures, one or more times, compression can take place in the first stage in a step manner with flow from the center to the periphery. The expansion (or compression) ratio in each stepped region will be one or larger. This configuration of the first stage is described in my U.S. Pat. No. 6,050,792, titled "Multi-Stage Scroll Compressor", which is incorporated herein by reference. This configuration has the added advantage of providing compression in the first stage, instead of expansion, making the first stage more efficient.

In an oil free or oilless scroll-type compressor, there are many leakage points. Typically, the scrolls operate with a small running clearance between the scrolls. This is a leakage point, and reduces performance. There is also leakage under the tip seal and at the blow hole on either side of the tip seal. By placing a small amount of a viscous, spreadable compound, such as grease or a dampening gel, on the scrolls, the blow holes and leakage paths are reduced or eliminated. The excess grease or dampening gel is purged during initial operation, leaving grease or gel in the gaps between the scrolls. The grease or dampening gel is applied to the tips and sides of the scrolls during assembly of the scroll compressors. This operation is simple, and adds almost no cost to the manufacture of the scroll compressors. The grease is preferably a low vapor pressure grease, such as Krytox, available from E.I. duPont de Nemours. The dampening gel is preferably NyeTorr, available from Nye Lubricant, Inc. of Fairhaven, Mass.

In some applications (such as in the food industry or pharmaceutical industry), it is not acceptable to have a grease or dampening gel in the scrolls for fear of downstream contamination. As an alternative to the grease or dampening gel, a one or two part epoxy can be placed on the scroll tips and sides during assembly of the scroll compressor, in the same manner as the grease or dampening gel. The unit can then be run, and any excess will be purged from the scroll compressor. If the epoxy requires a post cure, after an initial run, the scrolls can be disassembled and the epoxy can be cured. Then, the scroll compressor can be reassembled. The epoxy will be hard, and will not cause any downstream contamination.

As can be appreciated, by applying the grease, dampening gel, or epoxy to the scroll tips and sides, the grease, dampening gel, or epoxy will conform to the shape of any gap between the scroll tip and its adjacent scroll plate (i.e., between the scroll tip of the rotating scroll, and the plate of the stationary scroll), substantially eliminating the gap. The scroll pump will thus have minimal leakage, and optimal performance of the scroll pump, compressor, or vacuum pump will be achieved without the use of an expensive injection molding process or the use of expensive swing links.

In view of the above, it will be seen that the advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. Although only two stages are shown, more stages or a single stage could be employed. Thus, the scroll compressor could have one, three, four or more stages. There could be a mid-port for each stage, to allow for various stages to be by-passed, connected in series, or open to the atmosphere, as may be desired for a particular function.

I claim:

1. A method of assembling a scroll compressor, the scroll compressor comprising a housing, a fixed plate having a spiral involute wrap and an orbiting plate having a spiral involute wrap received in said housing such that the spiral involute wraps mesh with each other to define chambers, and a cover to close said housing; said method comprising:

applying a sealant to tips and sides of said involute wraps; the sealant being a one or two part epoxy;

running said scroll compressor after said scroll compressor is assembled; and dissembling said scroll compressor after said initial run; curing said epoxy sealant; and reassembling said scroll compressor.

* * * * *